US008829801B2

(12) United States Patent
Lee

(10) Patent No.: US 8,829,801 B2
(45) Date of Patent: Sep. 9, 2014

(54) POWER CONTOLLERS AND CONTROL METHODS

(75) Inventor: Ching-Tsan Lee, Miaoli County (TW)

(73) Assignee: Leadtrend Technology Corporation, Hsinchu (TW)

( * ) Notice: Subject to any disclaimer, the term of this patent is extended or adjusted under 35 U.S.C. 154(b) by 152 days.

(21) Appl. No.: 13/549,858

(22) Filed: Jul. 16, 2012

(65) Prior Publication Data

US 2013/0033184 A1 Feb. 7, 2013

(30) Foreign Application Priority Data

Aug. 5, 2011 (TW) ..... 100127885 A

(51) Int. Cl.
*H05B 37/02* (2006.01)
*H05B 33/08* (2006.01)

(52) U.S. Cl.
CPC ..... *H05B 33/0827* (2013.01); *H05B 33/0851* (2013.01)
USPC ..... 315/186; 315/185 R; 315/224; 315/307; 315/246

(58) Field of Classification Search
CPC ..... H05B 33/0809–33/0845
USPC ..... 315/185 R, 186, 210, 224, 200 R, 122, 315/246, 291, 294, 307
See application file for complete search history.

(56) References Cited

U.S. PATENT DOCUMENTS

| | | | | |
|---|---|---|---|---|
| 8,120,280 | B2 * | 2/2012 | Yi et al. | 315/294 |
| 8,390,214 | B2 * | 3/2013 | Van Laanen et al. | 315/294 |
| 8,456,106 | B2 * | 6/2013 | Mednik et al. | 315/307 |
| 8,521,113 | B2 * | 8/2013 | Mergen et al. | 455/226.4 |
| 2008/0018261 | A1 * | 1/2008 | Kastner | 315/192 |
| 2008/0150449 | A1 * | 6/2008 | Wang et al. | 315/291 |
| 2011/0140621 | A1 * | 6/2011 | Yi et al. | 315/224 |

* cited by examiner

*Primary Examiner* — Vibol Tan
(74) *Attorney, Agent, or Firm* — McClure, Qualey & Rodack, LLP

(57) ABSTRACT

Disclosure has power controllers and control methods used therein. A disclosed power controller is adapted for a power converter to power at least one light emitting diode. The power converter includes a power switch with a control gate to make an inductive energized or de-energized. The power converter receives a dimming signal to substantially control the lighting of the light emitting diode. The power controller has a gate-driving circuit, for driving the control gate according to a pulse-width signal and the dimming signal. When the dimming signal is asserted the gate-driving circuit has a first driving force. When the dimming signal is deasserted the gate-driving circuit has a second driving force less than the first driving force.

22 Claims, 7 Drawing Sheets

POWER CONTOLLERS AND CONTROL METHODS

CROSS-REFERENCE TO RELATED APPLICATION

This application claims priority to and the benefit of Taiwan Application Serial Number 100127885, filed on Aug. 5, 2011, which is incorporated by reference in its entirety.

BACKGROUND

The present disclosure relates generally to power supplies for light emitting diodes (LEDs), especially for power supplies with the ability of suppressing or reducing audio noise.

This is an era that power consumption and efficiency are important issues for almost every device in this modern world. LEDs, because of their excellent power efficiency and compact device size, have become more and more popular in lighting markets. For example, the cold-cathode fluorescent lamps (CCFL) in the back-light modules of liquid-crystal-display (LCD) panels have largely been replaced by LEDs.

FIG. 1 illustrates back light module 8 with LEDs and a power supply. The power supply of FIG. 1 has two stages: voltage-controlled stage 4 and current-controlled stage 6. As shown in FIG. 1, voltage-controlled stage 4 is a booster, in which power controller 18 alternatively turns on and off power switch 15 to store electric power in inductive device PRM and to release the stored electric power such that output voltage $V_{OUT}$ with required specifications is built up at output node OUT connected to LEDs. Current controller 20 in current-controlled stage 6 majorly balances the currents through the LED chains, such that the currents are substantially the same in amplitude and all LED chains illuminate evenly.

To adjust the brightness of an LCD panel, back light module 8 could receive a dimming signal $V_{DIM}$ to substantially control the lighting of the LED chains. Generally speaking, when dimming signal $V_{DIM}$ is asserted, the LED chains illuminate, and when dimming signal $V_{DIM}$ is deasserted, the LED chains stop illuminating. The duty cycle of dimming signal $V_{DIM}$, that is, the asserted time in proportion to the cycle time, determines the intensity of lighting felt by human eyes.

FIG. 2 shows dimming signal $V_{DIM}$ at dimming node DIM, gate signal $V_{GATE}$ at gate node GATE, current $I_{IN}$ flowing into inductive device PRM from input node $V_{IN}$, and output voltage $V_{OUT}$ at output node OUT. During the dimming-ON period when dimming signal $V_{DIM}$ is asserted, power controller 18 outputs gate signal $V_{GATE}$ to alternatively turn on and off power switch 15. Meanwhile, current $I_{IN}$ is drained from input node $V_{IN}$ to build up output voltage $V_{OUT}$. Current controller 20 also conducts and spreads current $I_{IN}$ through LED chains to illuminate.

During the dimming-OFF period when dimming signal $V_{DIM}$ is deasserted, power controller 18 deasserts gate signal $V_{GATE}$, current $I_{IN}$ is about 0 A, and output voltage $V_{OUT}$ might slightly ramp down over time due to some leakage current. Current controller 20 could cut the current paths through the LED chains so that the LED chains stop illuminating.

From the perspective of voltage-controlled stage 4, it can be found from the signals in FIG. 2 that switching between the dimming-OFF period and the dimming-ON period is equivalent, per se, to switching between no load and heavy load. Even if the frequency of dimming signal $V_{DIM}$ might be as low as 200 Hz within the frequency range hardly heard by human, the load transition is so large that current $I_{IN}$ could has considerable energy allocated in some frequencies harmonic to the frequency of dimming signal $V_{DIM}$ and cause inductive device PRM to generate noise, which is unpleasant to human and should be erased or diminished in consumer products.

BRIEF DESCRIPTION OF THE DRAWINGS

The invention can be more fully understood by the subsequent detailed description and examples with references made to the accompanying drawings, wherein.

DETAILED DESCRIPTION

In this specification, the devices with the same symbol refer to the devices with substantially the same or similar function, structure, compound or application, but are not necessarily all the same. After reading this specification, persons skilled in the art can replace or alter some devices in the embodiments without departing the essence of the invention. Accordingly, the embodiments herein are not used for limiting the scope of the invention.

Figure 1:
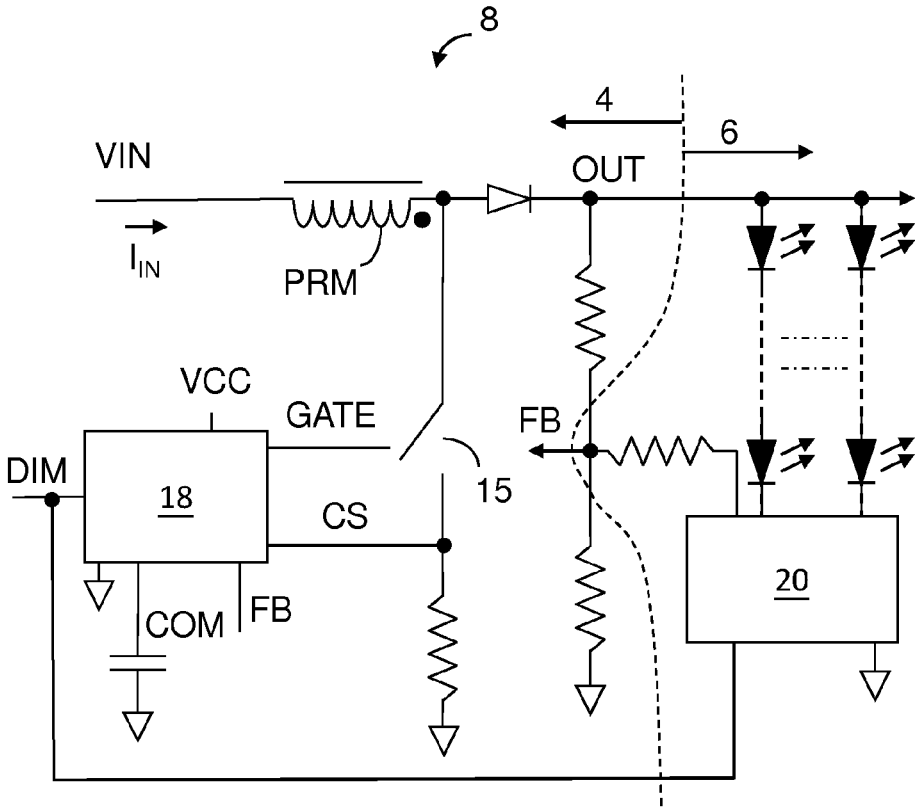
FIG. 1 illustrates a back light module with LEDs and a power supply.
Figure 2:
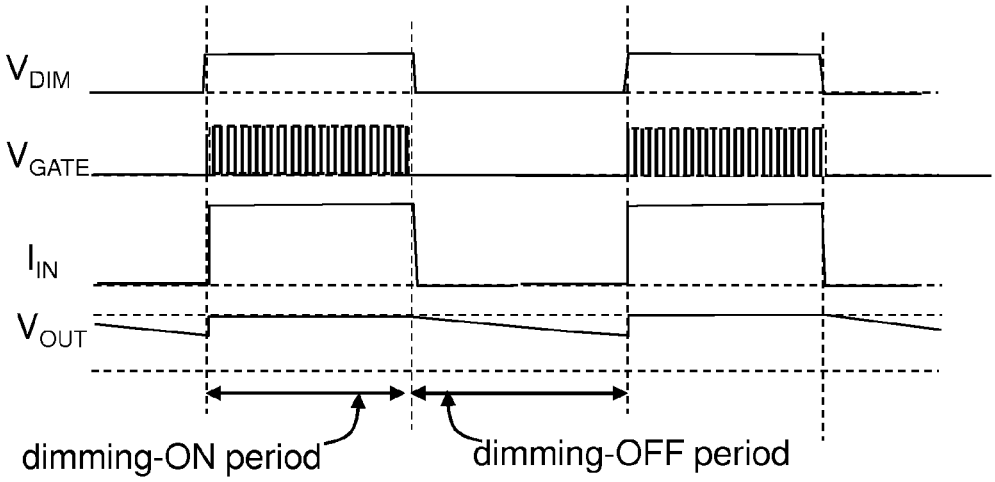
FIG. 2 shows dimming signal $V_{DIM}$ at dimming node DIM, gate signal $V_{GATE}$ at gate node GATE, current $I_{IN}$ flowing into inductive device PRM from input node $V_{IN}$, and output voltage $V_{OUT}$ at output node OUT.
Figure 3A:
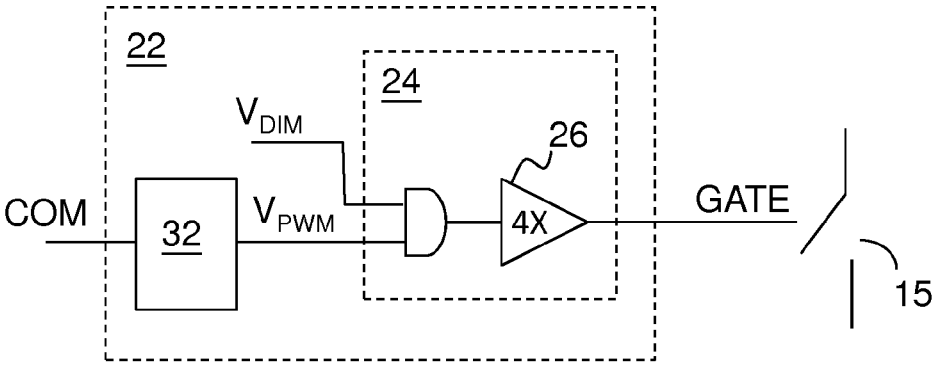
FIG. 3A demonstrates a power controller employed in the power controller of FIG. 1.

FIG. 3A demonstrates power controller 22, which, as an example, is employed in power controller 18 of FIG. 1. Power controller 22 has pulse width modulator 32 and gate-driving circuit 24. Pulse-width signal $V_{PWM}$ is generated according to compensation signal $V_{COM}$ at compensation node COM. For example, the higher the compensation signal $V_{COM}$, the longer the ON time when pulse-width signal $V_{PWM}$ is asserted to make power switch 15 perform a short circuit, the more the electric energy stored in an inductive device, and the higher the power a corresponding power converter converts. Gate-driving circuit 24 drives gate node GATE of power switch 15, generating gate signal $V_{GATE}$ based on pulse-width signal $V_{PWM}$ and dimming signal $V_{DIM}$. It can be derived from the schematic of gate-driving circuit 24 that, when dimming signal is asserted, gate signal $V_{GATE}$ at gate node GATE is substantially in phase with pulse-width signal $V_{PWM}$. Gate-driving circuit 24 has driver 26, which, as an example to compare with embodiments, has a driving force of 4 units to drive gate node GATE.

Figure 3B:
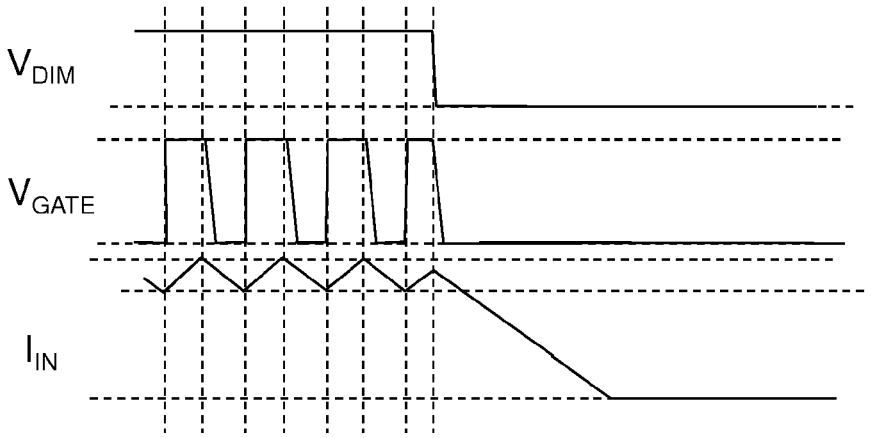
FIG. 3B shows waveforms of dimming signal $V_{DIM}$, gate signal $V_{GATE}$, and current $I_{IN}$ drained to the LED chains from input node $V_{IN}$ according to the power controller of FIG. 3A.

FIG. 3B shows dimming signal $V_{DIM}$, gate signal $V_{GATE}$, and current $I_{IN}$ drained to the LED chains from input node $V_{IN}$. As shown in FIG. 3B, when dimming signal $V_{DIM}$ is asserted, driver 26 generates gate signal $V_{GATE}$, using its driving force of 4 units, such that power switch 15 is periodically turned ON and OFF, and current $I_{IN}$ vibrates within a certain range to power the LED chains of FIG. 1. When dimming signal $V_{DIM}$ is deasserted, driver 26 uses its driving force of 4 units to deassert gate signal $V_{GATE}$, whose voltage, as a result, drops quickly and stays around 0 volt, completely turning off power switch 15. For power switch 15 is turned off, current $I_{IN}$ decreases linearly over time and become 0 A eventually.

Figure 4A:
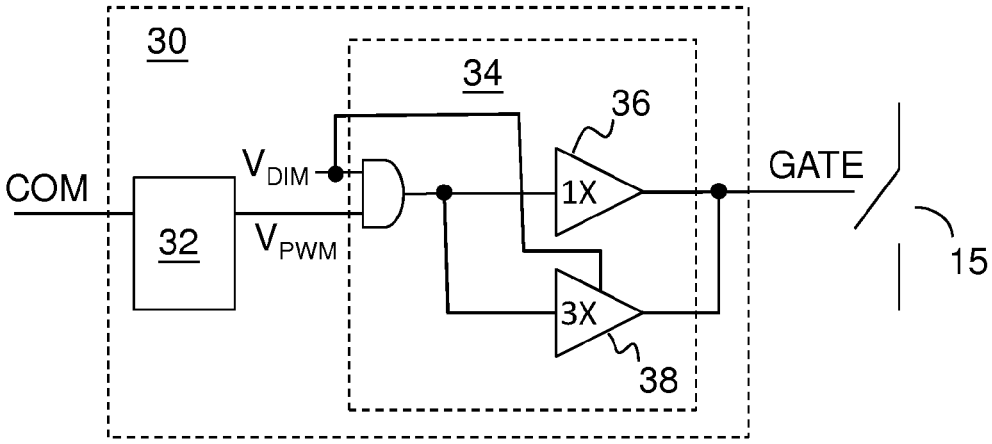
FIG. 4A demonstrates a power controller according to one embodiment of the invention.

FIG. 4A demonstrates power controller 30, which in one embodiment of the invention replaces power controller 18 of FIG. 1. Power controller 30 has pulse width modulator 32 and gate-driving circuit 34. FIG. 4A share with FIG. 3A some common devices, which could be comprehensible to persons skilled in the art and will not be detailed in consideration of brevity.

Different to gate-driving circuit 24 of FIG. 3A having a single driver 26, gate-driving circuit 34 of FIG. 4A includes two drivers 36 and 38, having driving force of 1 unit and 3 units respectively. For instance, in one embodiment, the maximum pulling-down current that driver 36 can afford is 10 mA, and the maximum pulling-down current that driver 38 can afford is 30 mA, such that the driving force of driver 38 is three times that of driver 36. In another embodiment, the pulling-down resistance of driver 36 is three times that of driver 38 to make the driving force of driver 38 three times that of driver 36. When dimming signal $V_{DIM}$ is asserted, gate signal $V_{GATE}$ is substantially in phase with pulse-width signal $V_{PWM}$, and drivers 36 and 38 together use driving force of 4 units in total to generate gate signal $V_{GATE}$. When signal $V_{DIM}$ is deasserted, driver 38 is disabled, its output impedance becomes so large, and it drives no more the control gate of power switch 15. Thus, driver 36 alone deasserts gate signal $V_{GATE}$, using driving force of 1 unit.

Figure 4B:
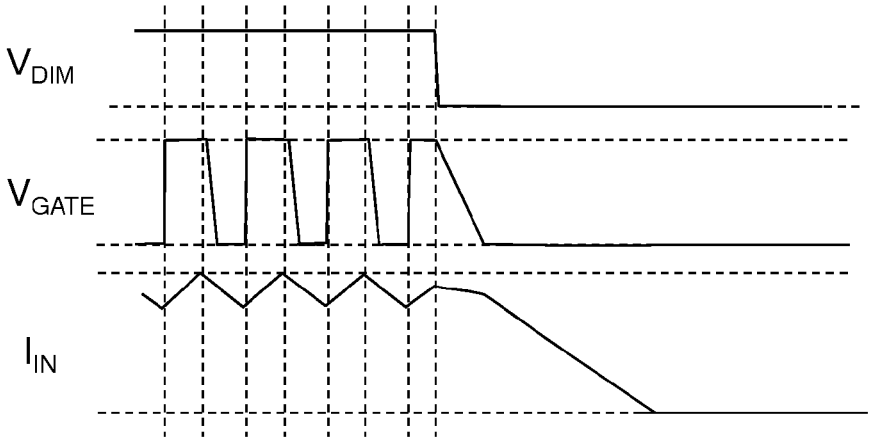
FIG. 4B shows waveforms of dimming signal $V_{DIM}$, gate signal $V_{GATE}$, and current $I_{IN}$ drained to the LED chains from input node $V_{IN}$, according to the embodiment of FIG. 4A.

FIG. 4B shows waveforms of dimming signal $V_{DIM}$, gate signal $V_{GATE}$, and current $I_{IN}$ drained to the LED chains from input node $V_{IN}$, according to the embodiment of FIG. 4A. Unlike the gate signal $V_{GATE}$ in FIG. 3B, whose voltage, when dimming signal $V_{DIM}$ switches to being asserted, drops quickly because of the driving force of 4 units, gate signal $V_{GATE}$ in FIG. 4B drops relatively slower when dimming signal $V_{DIM}$ switches to being asserted, because the driving force to pull down gate signal $V_{GATE}$ is mere 1 unit. Accordingly, current $I_{IN}$ in FIG. 4B can hold for a short period of time and then, when gate signal $V_{GATE}$ is surely deasserted to complete turn OFF power switch 15, decreases linearly over time and become 0 A eventually.

Comparing with the waveform of current $I_{IN}$ in FIG. 3B, current $I_{IN}$ in FIG. 4B varies milder, especially when dimming signal $V_{DIM}$ is switched to being deasserted. It can be derived from spectrum analysis that a signal that varies relatively milder will have stronger energy to its fundamental frequency and less energy to its harmonic frequencies. As aforementioned, audio noise might happen easily if the energy to the harmonic frequencies of a signal is large even though the fundamental frequency of the signal locates within a frequency range less audible to human. Since power controller 30 of FIG. 4A renders relatively-less energy to harmonic frequencies, it is more-likely that power controller 30 can reduce the audio noise caused by harmonic frequencies.

Figure 5:
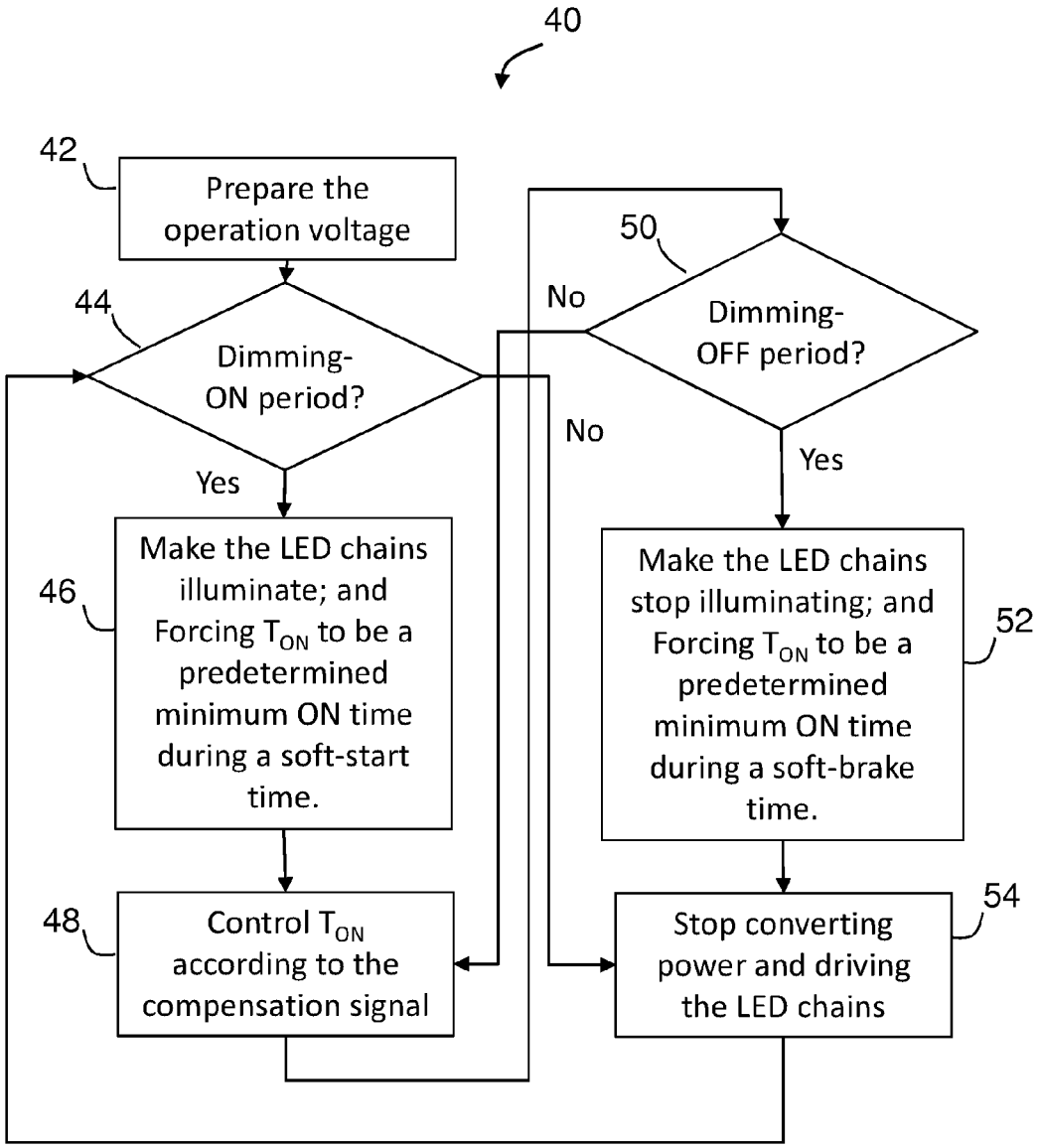
FIG. 5 shows a control method adapted to the power controller of FIG. 3A or the power controller of FIG. 4A.

FIG. 5 shows control method 40 adapted to power controller 22 of FIG. 3A or power controller 30 of FIG. 4A. Control method 40 is used in power controller 30 in one embodiment of the invention.

In step 42, power controller 30 makes sure that operation voltage $V_{CC}$ is well prepared for power controller 30 to properly function. For example, in one embodiment, operation voltage $V_{CC}$ must exceed a certain level to be claimed as being well prepared.

Step 44 follows, where power controller 30 checks whether it should operate in a dimming-ON period or a dimming-OFF period. For example, if dimming signal $V_{DIM}$ is asserted, power controller 30 should operate in a dimming-ON period and step 46 follows. In the contrary, if dimming signal $V_{DIM}$ is deasserted, power controller 30 should operate in a dimming-OFF period and step 54 follows.

In step 46, for a predetermined number of subsequent switch cycles, the ON time $T_{ON}$ in each switch cycle is forced to be a predetermined minimum ON time, independent to compensation signal $V_{COM}$ at compensation node COM. The time period for this predetermined number of subsequent switch cycles could be referred to as a soft-start time. In the meantime, current controller 20 in FIG. 1 starts conducting and spreading current $I_{IN}$ through LED chains to illuminate. Following step 46 is step 48.

In step 48, power controller 30 controls ON time $T_{ON}$ of power switch 15 in a following switch cycle according to compensation signal $V_{COM}$, such that the LED chains are powered to illuminate. Step 50 follows.

It can be found from the sequence with steps 44, 46 and 48, that step 46 likely provides a soft-start mechanism, which limits the power converted by the voltage-controlled stage during the soft-start time at the beginning of a dimming-ON period. The power during the soft-start time is less than the power actually required by the current-controlled stage. After the soft-start time, as being in responsive to compensation signal $V_{COM}$, power controller 30 makes the voltage-controlled stage provide the power substantially required by the current-controlled stage for illuminating the LED chains.

In step 50, power controller 30 again checks whether it should operate in a dimming-ON period or a dimming-OFF period. For example, if dimming signal $V_{DIM}$ is still asserted, power controller 30 should continuously operate in a dimming-ON period and control method 40 proceeds back to step 48. In the contrary, if dimming signal $V_{DIM}$ is deasserted, power controller 30 should switch to a dimming-OFF period and control method 40 proceeds to step 52.

Step 52 is similar with step 46. In step 52, for another predetermined number of subsequent switch cycles, the ON time $T_{ON}$ in each switch cycle is forced by power controller 30 to be the predetermined minimum ON time, independent to compensation signal $V_{COM}$ at compensation node COM. The time period for this predetermined number of the subsequent switch cycles in step 52 could be referred to as a soft-brake time. During the soft-brake time, current controller 20 in FIG. 1 stops conducting and spreading current $I_{IN}$ such that the LED chains stop illuminating. Following step 52 is step 54.

In step 54, power controller 30 does not convert electric power and provide current to drive the LED chains. In the meantime, the LED chains are kept as not illuminating. For example, power controller 30 makes and keeps gate signal $V_{GATE}$ deasserted, such that power switch 15 remains as turned OFF so no electric power is converted.

It can be found from the sequence with steps 50, 52 and 54, that step 52 likely provides a soft-brake mechanism, which, before power conversion is complete stopped, keeps little but not zero power converted by the voltage-controlled stage during the soft-brake time at the beginning of a dimming-OFF period, in which no power is actually required as the LED chains do not illuminate. After the soft-brake time, power controller 30 constantly turns off power switch 15, stopping the electric power conversion in the voltage-control stage and current $I_{IN}$ to the current-controlled stage.

Figure 6A:
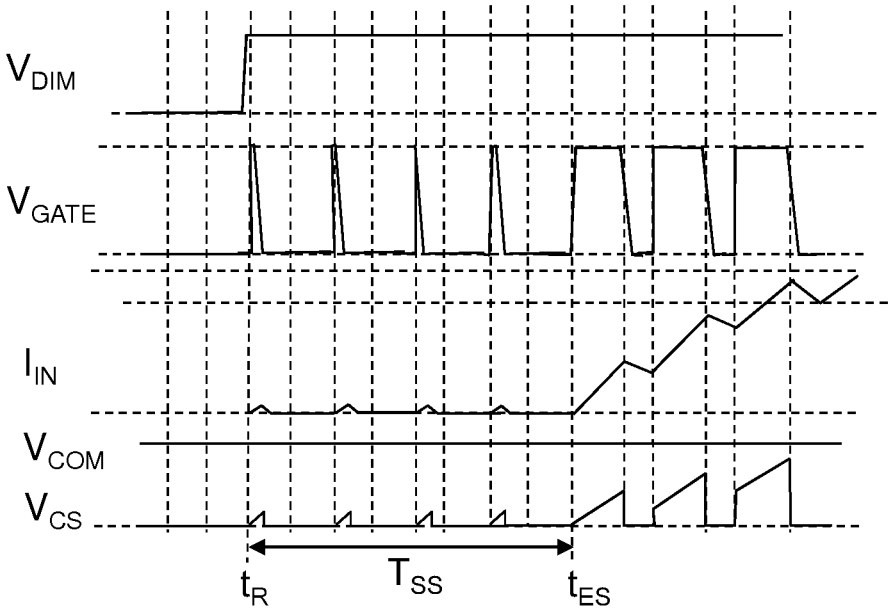
FIG. 6A shows some signal waveforms around the transition from a dimming-OFF period to a dimming-ON period according to the control method of FIG. 5.
Figure 6B:
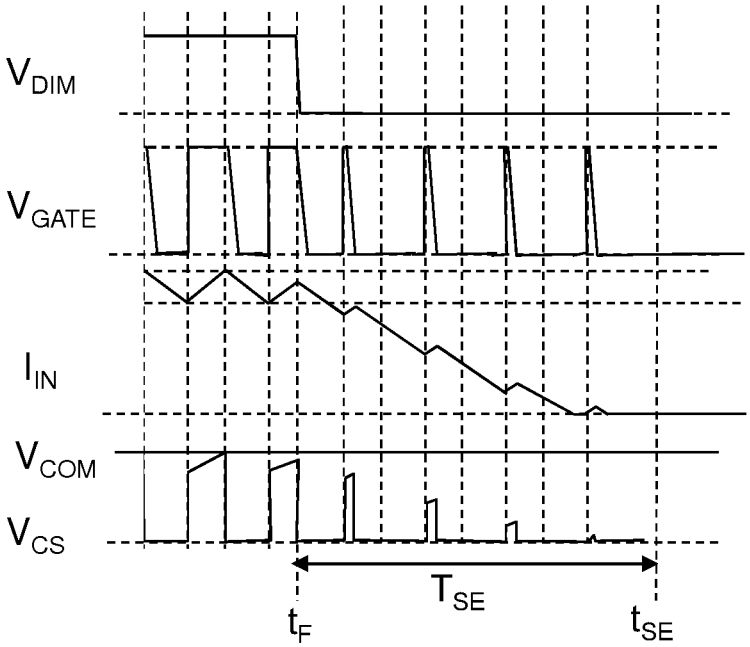
FIG. 6B shows some signal waveforms around the transition from a dimming-ON period to a dimming-OFF period according to the control method of FIG. 5.

FIG. 6A shows some signal waveforms around the transition from a dimming-OFF period to a dimming-ON period, while FIG. 6B does some signal waveforms around the transition from a dimming-ON period to a dimming-OFF period according to control method 40 of FIG. 5. Signal waveforms in each of FIGS. 6A and 6B refer to, from top to bottom, dimming signal $V_{DIM}$, gate signal $V_{GATE}$, current $I_{IN}$, compensation signal $V_{COM}$, and voltage signal $V_{as}$ at current-sense node CS.

At time $t_R$ in FIG. 6A, dimming signal $V_{DIM}$ is switched to be asserted, such that a dimming-OFF period ends and a dimming-ON period begins. Soft-start time $T_{SS}$, the period from time $t_R$ to time $t_{ES}$ at the beginning of a dimming-ON period, has four switch cycles. During soft-start time $T_{SS}$, each ON time of power switch 15, as shown in FIG. 6A, is fixed to be the minimum ON time predetermined by power controller 30, even though compensation signal is demanding longer ON time and more power. After time $t_{ES}$, the ON time of power switch 15 is determined by compensation signal $V_{COM}$ and might be as long as the maximum ON time predetermined by power controller 30. It can found in FIG. 6A that the power converted during soft-start time $T_{SS}$ is less than what compensation voltage $V_{COM}$ corresponds to or demands.

At time $t_F$ in FIG. 6B, dimming signal $V_{DIM}$ is switched to be deasserted, such that a dimming-ON period ends and a dimming-OFF period begins. Soft-brake time $T_{SE}$, the period from time $t_F$ to time $t_{SE}$ at the beginning of a dimming-OFF period, has four switch cycles. During soft-brake time $T_{SE}$, each ON time of power switch 15, as shown in FIG. 6B, is fixed to be the minimum ON time predetermined by power controller 30, even though the LED chains stop illuminating and require no power. After time $t_{SE}$, power switch 15 is no more turned on, and gate signal $V_{GATE}$ is constantly deasserted. It can found in FIG. 6B that the power converted during braking time $T_{SE}$ is more than 0, but less than what compensation voltage $V_{COM}$ corresponds to or demands.

Figure 7:
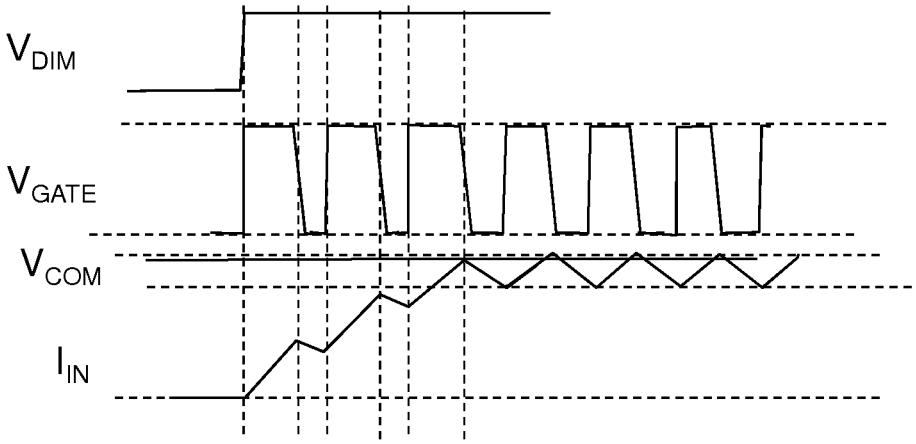
FIG. 7 shows some signal waveforms, including dimming signal $V_{DIM}$, gate signal $V_{GATE}$, compensation signal $V_{COM}$, current $I_{IN}$, around the transition from a dimming-OFF period to a dimming-ON period while no soft-start mechanism is used.

FIG. 7 shows some signal waveforms, including dimming signal $V_{DIM}$, gate signal $V_{GATE}$, compensation signal $V_{COM}$, current $I_{IN}$, around the transition from a dimming-OFF period to a dimming-ON period while no soft-start mechanism is used. In comparison with current $I_{IN}$ in FIG. 7, current $I_{IN}$ in FIG. 6A, due to the introduction of the soft-start mechanism, rises relatively milder around the transition from a dimming-OFF period to a dimming-ON period. Accordingly, it is possible that current $I_{IN}$ in FIG. 6A causes relatively less audio noise.

Similarly, by comparing with current $I_{IN}$ in FIG. 3B, which employs no braking mechanism, current $I_{IN}$ in FIG. 6B, due to the introduction of the soft-braking mechanism, falls relatively milder. Accordingly, it is possible that current $I_{IN}$ in FIG. 6B causes relatively less audio noise.

During the soft-brake time, the LED chains do not illuminate such that the power provided or converted by the voltage-controlled stage during the soft-brake time is not consumed, but stored at output node OUT. This stored power might make up for the lack during the following soft-start time when the voltage-controlled stage provides power less than that demanded by the LED chains. Accordingly, employing both the soft-start and soft-brake mechanisms in one embodiment might be beneficial in reducing variation of compensation signal $V_{COM}$.

One power controller according to the invention might be configured to perform the soft-start and/or soft-brake mechanisms introduced in FIG. 5 and, as well, the driving-force control introduced in FIG. 4A. Another power controller according to the invention might be configured to perform only the soft-start and/or soft-brake mechanisms, but not the driving-force control. Another power controller according to the invention might be configured to perform only the driving-force control, but not the soft-start and/or soft-brake mechanisms.

Figure 8:
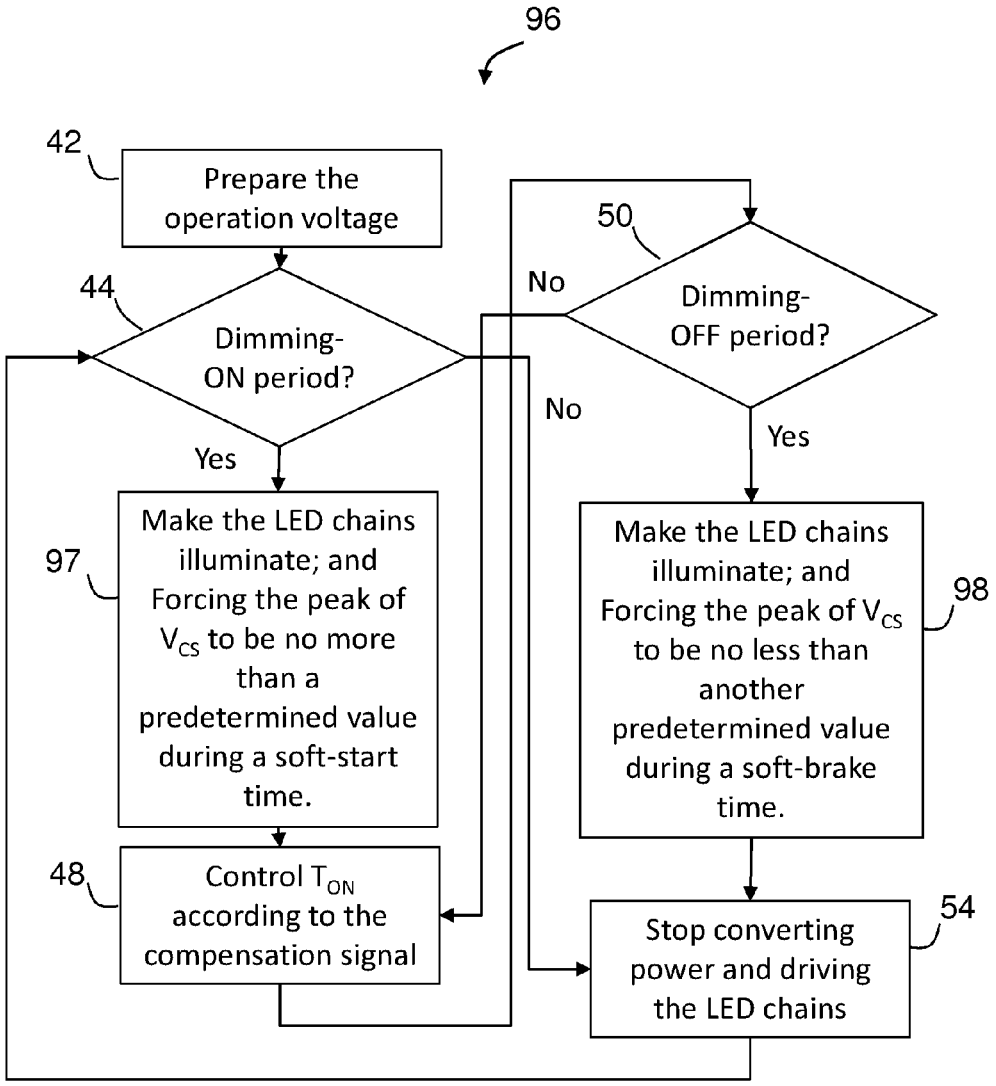
FIG. 8 shows a control method according to one embodiment of the invention.

It is not necessary that the ON time of a power switch in each switch cycle during the soft-start time and the soft-brake time must be the minimum ON time. In another embodiment, what is limited during the soft-start time and the soft-brake time is the peak value of voltage signal $V_{CS}$, which corresponds to the peak current flowing through inductive device PRM. In control method 96 shown in FIG. 8, voltage signal $V_{CS}$ for each switch cycle during a soft-brake time is forced to be at least a first predetermined value, as indicated by step 98. Similarly, voltage signal $V_{CS}$ for each switch cycle during a soft-start time is forced to be no more than a second predetermined value, as indicated by step 97 in FIG. 8. The first and second predetermined values are the same in one embodiment, while they might be different in another embodiment.

In one embodiment, during a dimming-ON period, regardless it is within a soft-start time or not, compensation node COM will be charged or discharged according to the feedback voltage at feedback node FB. Accordingly, compensation signal $V_{COM}$ substantially corresponds to the power required by the LED chains to illuminate. During a dimming-OFF time, nevertheless, compensation node COM is isolated or stopped from being charged or discharged, such that compensation signal $V_{COM}$ is substantially held or sustained by an external compensation capacitor. When switching to a following dimming-ON period, as compensation signal $V_{COM}$ substantially keeps its value as of the ending of the previous dimming-ON period, a voltage-controlled stage can quickly provide the power actually required by the LED chains.

According to the aforementioned analysis, embodiments of the invention might render current $I_{IN}$ with milder variation, resulting in reduced audio noise caused by harmonic frequencies.

Even though FIG. 1 exemplifies an embodiment of the invention by way of booster topology, the invention is not limited to. For example, embodiments of the invention might be flyback converters, buck converters, buck-boosters, and the like.

While the invention has been described by way of examples and in terms of preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power controller adapted for a power converter to power at least one light emitting diode, wherein the power converter includes a power switch with a control gate to make an inductive device energized or de-energized, and the power converter receives a dimming signal to substantially control the lighting of the light emitting diode, the power controller comprising:

a gate-driving circuit, for driving the control gate according to a pulse-width signal and the dimming signal;

wherein when the dimming signal is asserted the gate-driving circuit has a first driving force; and when the dimming signal is deasserted the gate-driving circuit has a second driving force less than the first driving force; and wherein both the first and second driving forces are for turning off the power switch.

2. The power controller of claim 1, wherein when the dimming signal is deasserted the gate-driving circuit employs the second driving force to turn off the power switch.

3. The power controller of claim 1, wherein the gate-driving circuit has a first driver and a second driver to cooperatively drive the control gate, and when the dimming signal is deasserted the first driver is disabled.

4. The power controller of claim 1, furthering comprising a pulse-width modulator for providing the pulse-width signal according to a compensation signal, wherein the compensation signal substantially corresponds to the electric power required by the light emitting diode.

5. A power converter for powering at least one light emitting diode chain with light emitting diodes, comprising:

a current-controlled stage for substantially determining the lighting of the light emitting diode chain according to a dimming signal; and a voltage-controlled stage, for building up an output voltage at an output node connected to the light emitting diode chain, comprising:

a power switch with a control gate to make an inductive device energized or de-energized; and a gate-driving circuit, for driving the control gate according to a pulse-width signal and the dimming signal;

wherein when the dimming signal is asserted the gate-driving circuit has a first driving force; and when the dimming signal is deasserted the gate-driving circuit has a second driving force less than the first driving force; and wherein both the first and second driving forces are for turning off the power switch.

6. The power converter of claim 5, wherein when the dimming signal is deasserted the gate-driving circuit employs the second driving force to turn off the power switch.

7. The power converter of claim 5, wherein the gate-driving circuit has a first driver and a second driver to cooperatively drive the control gate, and when the dimming signal is deasserted the first driver is disabled.

8. The power converter of claim 5, wherein the voltage-controlled stage further comprises a pulse-width modulator for providing the pulse-width signal according to a compensation signal, wherein the compensation signal substantially corresponds to the electric power required by the light emitting diode chain.

9. The power converter of claim 8, wherein the compensation signal is determined by a feedback voltage output by the current-controlled stage.

10. A control method adapted for a power converter to power at least one light emitting diode, the control method comprising:

receiving a dimming signal, wherein the dimming signal substantially controls the lighting of the light emitting diode;

providing a gate-driving circuit to drive a control gate of a power switch, wherein the power switch is coupled to make an inductive device energized or de-energized;

making the gate-driving circuit have a first driving force when the dimming signal is asserted; and making the gate-driving circuit have a second driving force less than the first driving force when the dimming signal is deasserted;

wherein both the first and second driving forces are for turning off the power switch.

11. The control method of claim 10, wherein the gate-driving circuit has a first driver and a second driver for driving the control gate, the control method further comprising:

disabling the first driver when the dimming signal is deasserted.

12. The control method of claim 10, wherein when the dimming signal is deasserted, the second driver turns off the power switch, using the second driving force.

13. The control method of claim 10, wherein the inductive device is energized or de-energized to build up an output voltage at an output node connected to the light emitting diode.

14. A control method adapted for a power converter to power at least one light emitting diode, wherein a dimming signal substantially controls the lighting of the light emitting diode, the control method comprising:

powering the light emitting diode according to a compensation signal substantially when the dimming signal is asserted, wherein the compensation signal corresponds to a first power substantially required by the light emitting diode for lighting;

stopping powering the light emitting diode substantially when the dimming signal is deasserted; and during a predetermined time period after the dimming signal toggles, making the power converter convert a second power more than 0 and less than the first power to power the light emitting diode.

15. The control method of claim 14, wherein the power converter has a power switch and, during the predetermined time period, the ON time of the power switch for each switch cycle is a predetermined minimum ON time.

16. The control method of claim 15, wherein the ON time of the power switch for each switch is a predetermined minimum ON time, during both a soft-start time period after the dimming signal is switched from being deasserted to being asserted and a soft-brake time period after the dimming signal is switched from being asserted to being deasserted.

17. The control method of claim 14, wherein the power converter includes an inductive device, and, during a soft-start time period after the dimming signal is switched from being deasserted to being asserted, an inductor current through the inductive device is limited not to exceed a predetermined value in each switch cycle.

18. The control method of claim 14, wherein the power converter includes an inductive device, and, during a soft-brake time period after the dimming signal is switched from being asserted to being deasserted, an inductor current through the inductive device is forced not to be less than a predetermined value in each switch cycle.

19. The control method of claim 14, wherein the predetermined time period is after the dimming signal is switched from being asserted to being deasserted.

20. The control method of claim 14, wherein the predetermined time period is after the dimming signal is switched from being deasserted to being asserted.

21. The control method of claim 14, wherein the compensation signal is at a compensation node, the control method comprising:

preventing the compensation node from being charged or discharged when the dimming signal is deasserted; and making the compensation node charged or discharged according to a feedback voltage when the dimming signal is asserted.

22. The control method of claim 14, comprising:

during a first predetermined time period after the dimming signal is switched from being asserted to being deasserted, making the power converter convert a soft-brake power more than 0; and during a second predetermined time period after the dimming signal is switched from being de-asserted to being asserted, making the power converter convert a soft-start power independent to the power corresponding to the compensation signal.

* * * * *

UNITED STATES PATENT AND TRADEMARK OFFICE

CERTIFICATE OF CORRECTION

PATENT NO. : 8,829,801 B2
APPLICATION NO. : 13/549858
DATED : September 9, 2014
INVENTOR(S) : Lee It is certified that error appears in the above-identified patent and that said Letters Patent is hereby corrected as shown below:

On the title page, Item [54] please replace the title with "Power Controllers and Control Methods"

Signed and Sealed this
Twenty-fifth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,829,801 B2
APPLICATION NO. : 13/549858
DATED : September 9, 2014
INVENTOR(S) : Lee It is certified that error appears in the above-identified patent and that said Letters Patent is hereby corrected as shown below:

On the title page, Item [54] and in the Specification, Column 1, lines 1-2, please replace the title with "Power Controllers and Control Methods"

This certificate supersedes the Certificate of Correction issued November 25, 2014.

Signed and Sealed this
Twenty-third Day of December, 2014

Michelle K. Lee

Michelle K. Lee
*Deputy Director of the United States Patent and Trademark Office*